US010122154B1

(12) United States Patent
Yamamoto et al.

(10) Patent No.: US 10,122,154 B1
(45) Date of Patent: Nov. 6, 2018

(54) METHOD FOR MANUFACTURING SPARK PLUG USING A JIG HAVING A VARIED SHAPE RECESS TO PREVENT DISPLACEMENT OF THE NOBLE TIP DURING WELDING

(71) Applicant: NGK SPARK PLUG CO., LTD., Nagoya, Aichi (JP)

(72) Inventors: Hiroki Yamamoto, Iwakura (JP); Hidekazu Wakita, Ichinomiya (JP)

(73) Assignee: NGK SPARK PLUG CO. LTD., Nagoya (JP)

( * ) Notice: Subject to any disclaimer, the term of this patent is extended or adjusted under 35 U.S.C. 154(b) by 0 days.

(21) Appl. No.: 15/962,017

(22) Filed: Apr. 25, 2018

(30) Foreign Application Priority Data

May 2, 2017 (JP) ..... 2017-091505

(51) Int. Cl.
*H01T 21/02* (2006.01)
*H01T 13/20* (2006.01)
*H01T 13/39* (2006.01)
*H01T 13/40* (2006.01)

(52) U.S. Cl.
CPC ..... *H01T 13/39* (2013.01); *H01T 13/40* (2013.01); *H01T 21/02* (2013.01)

(58) Field of Classification Search
CPC ..... H01T 21/02; H01T 13/39; H01T 13/38; H01T 13/20; H01T 13/34; H01T 13/36; H01T 13/467; H01T 13/52
See application file for complete search history.

(56) References Cited

U.S. PATENT DOCUMENTS 4,700,103 A * 10/1987 Yamaguchi ..... H01T 13/39 313/141
2002/0073539 A1* 6/2002 Hori ..... H01R 43/0214 29/857
2017/0141546 A1* 5/2017 Fujii ..... H01T 13/20
2017/0256916 A1* 9/2017 Igarashi ..... H01T 13/39

FOREIGN PATENT DOCUMENTS

JP 2014-164797 A 9/2014

* cited by examiner

*Primary Examiner* — Tracie Y Green
(74) *Attorney, Agent, or Firm* — Stites & Harbison, PLLC; Jeffrey A. Haeberlin; James R. Hayne

(57) ABSTRACT

A method for manufacturing a spark plug includes pressing a tip in a first direction from a first surface thereof toward a second surface thereof via a jig when the tip is in contact with an electrode base material; and welding the electrode base material to the tip being pressed by the jig. The jig has a recessed portion which is brought into contact with an edge of the tip, and the recessed portion has a diameter-decreasing portion having an inner dimension that gradually decreases toward a second direction opposite to the first direction. The inner dimension of a first end portion in the first direction of the diameter-decreasing portion is larger than the outer dimension of the edge, and the inner dimension of a second end portion in the second direction of the diameter-decreasing portion is equal to the outer dimension of the edge.

5 Claims, 9 Drawing Sheets

METHOD FOR MANUFACTURING SPARK PLUG USING A JIG HAVING A VARIED SHAPE RECESS TO PREVENT DISPLACEMENT OF THE NOBLE TIP DURING WELDING

CROSS REFERENCE TO RELATED APPLICATION

The present application claims prior to Japanese Patent Application No. 2017-091505, which was filed on May 2, 2017, the disclosure of which is herein incorporated by reference in its entirety.

BACKGROUND OF THE INVENTION

Field of the Invention

The present invention relates to a method for manufacturing a spark plug, and particularly, relates to a method for manufacturing a spark plug in which a tip is welded to an electrode base material.

Description of Related Art

As a spark plug for igniting an air-fuel mixture, a spark plug is known which includes: a first electrode obtained by welding a noble-metal-containing tip to an electrode base material; and a second electrode opposed to the first electrode with a spark gap interposed therebetween. Patent Document 1 discloses a technique in which, when a tip placed on an electrode base material is to be welded thereto, the tip is pressed by a dedicated jig for the purposes of inhibiting the tip from being misaligned and of facilitating heat dissipation from the tip.

RELATED ART DOCUMENT

Patent Document 1 is Japanese Patent Application Laid-Open (kokai) No. 2014-164797.

BRIEF SUMMARY OF THE INVENTION

However, with the above-described conventional technique, a problem arises that, if the tip is placed at a position displaced from a target position on the electrode base material, the position of the tip is difficult to be corrected since the jig for pressing the tip has a flat surface. If the position of the tip is difficult to be corrected, there is a risk that the tip is welded at the position displaced from the target position.

The present invention has been conceived to solve the above-described problem, and an object of the present invention is to provide a method for manufacturing a spark plug, the method enabling the position of a tip to be easily corrected.

In order to attain the object, one aspect of the present invention is a method for manufacturing a spark plug including: a first electrode obtained by joining a noble-metal-containing tip to an electrode base material; and a second electrode opposed to a first surface of the tip with a spark gap interposed therebetween. The method includes: a pressing step of pressing the tip via a jig in a first direction from the first surface toward a second surface of the tip on a side opposite to the first surface in a state where the second surface is in contact with the electrode base material; and a welding step of welding the electrode base material and the tip being pressed by the jig, to each other.

The tip has: a side surface contiguous to the first surface and the second surface; and an edge at which the side surface and the first surface meet each other. The jig has a recessed portion to be brought into contact with the edge of the tip, and the recessed portion has a diameter-decreasing portion having an inner dimension that gradually decreases toward a second direction opposite to the first direction. The inner dimension of a first end portion in the first direction of the diameter-decreasing portion is larger than an outer dimension of the edge, and the inner dimension of a second end portion in the second direction of the diameter-decreasing portion is equal to the outer dimension of the edge. In the pressing step, the diameter-decreasing portion is brought into contact with at least a portion of the edge, and the tip is moved to a target position on the electrode base material to which the tip is to be welded.

In the exemplary method for manufacturing the spark plug, the recessed portion of the jig has the diameter-decreasing portion having an inner dimension that gradually decreases toward the second direction opposite to the first direction. The inner dimension of the first end portion in the first direction of the diameter-decreasing portion is larger than the outer dimension of the edge, and the inner dimension of the second end portion in the second direction of the diameter-decreasing portion is equal to the outer dimension of the edge. By the pressing step, the diameter-decreasing portion of the jig comes into contact with at least a portion of the edge of the tip so that the tip is pressed via the jig in the first direction from the first surface toward the second surface. By pressing the diameter-decreasing portion against the edge of the tip, the tip can be moved toward the target position owing to a reaction force to the pressing, whereby the position of the tip can be easily corrected before welding.

In accordance with one implementation, the diameter-decreasing portion is rotationally symmetric about a center axis passing a center of the diameter-decreasing portion and extending toward the first direction. Therefore, in addition to the effect as in the first aspect, by pressing the tip in the first direction with use of the jig, the tip can be easily moved toward the center of the diameter-decreasing portion.

In accordance with yet another implementation, in the pressing step, the diameter-decreasing portion is brought into contact with the edge of the tip while the jig and the electrode base material are rotated relative to each other, whereby, in addition to the effect as in the second aspect, the tip can be further easily moved toward the center of the diameter-decreasing portion.

In accordance with still yet another implementation, the recessed portion has a bottom portion contiguous to the second end portion of the diameter-decreasing portion. In the pressing step, after the diameter-decreasing portion comes into contact with the edge of the tip, the bottom portion comes into contact with an entirety of the first surface of the tip. Thus, as compared with a case where the edge of the tip is pressed by the recessed portion of the jig, load that is applied to the tip by the jig can be dispersed. Therefore, in addition to the effect as in any of the first to third aspects, the edge of the tip can be prevented from being damaged by being pressed by the jig.

In still yet another implementation, in the pressing step, in a state where the target position and the center of the diameter-decreasing portion at the second end portion are aligned with each other, the diameter-decreasing portion is brought into contact with the edge of the tip, and the tip is pressed in the first direction. As a result, even without moving the jig in a direction orthogonal to the first direction, the position of the tip can be corrected to the target position just by moving the jig in the first direction. Since it can be made unnecessary to provide any mechanism for moving the jig in a direction orthogonal to the first direction, the mechanism for moving the jig can be simplified in addition to the effect as in any of the first to fourth aspects.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE INVENTION

Figure 1:
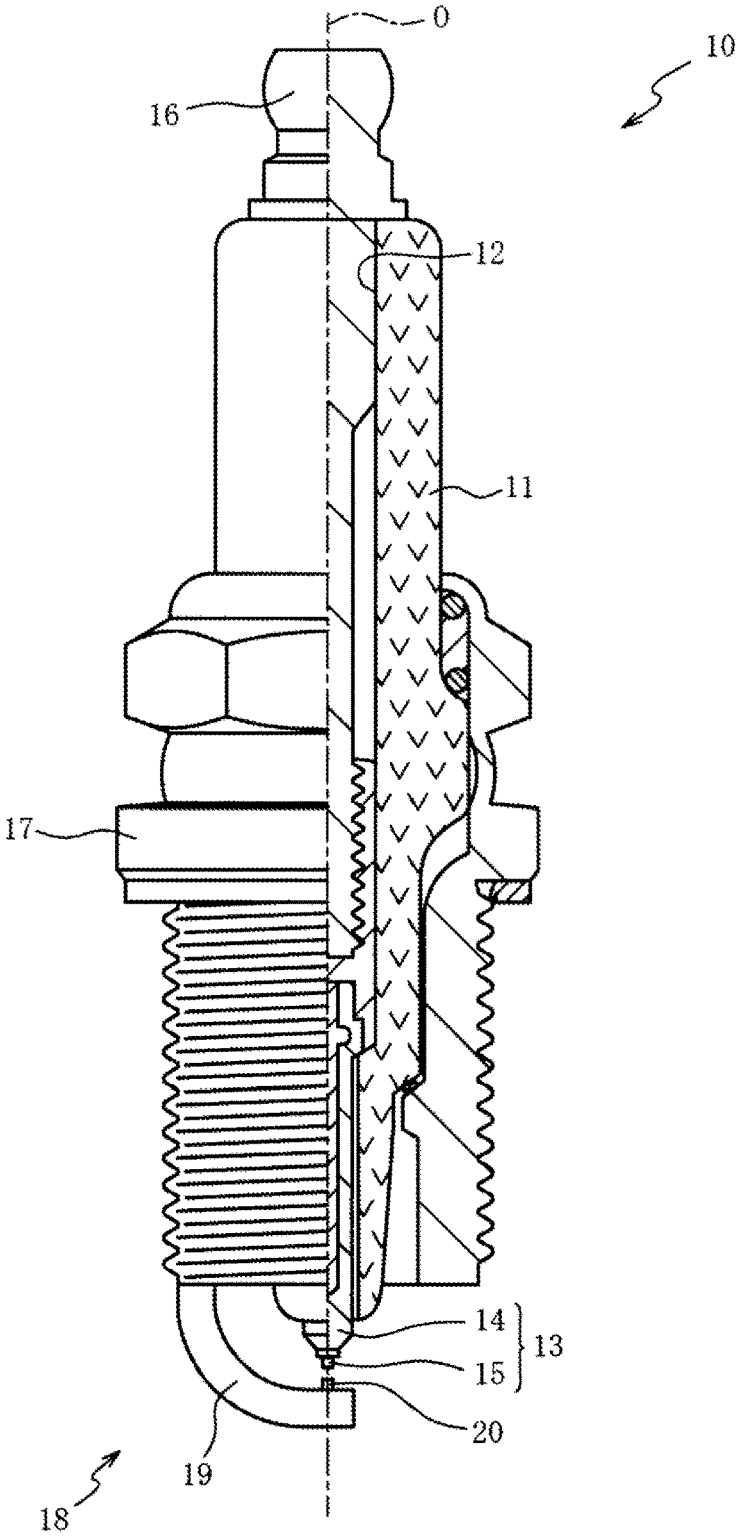
FIG. 1 is a half-sectional view of a spark plug, according to an embodiment of the present invention.

Hereinafter, preferred embodiments of the present invention will be described with reference to the accompanying drawings. FIG. 1 is a half-sectional view of a spark plug 10 according to an embodiment of the present invention, with an axis O as a boundary. The lower side in the sheet of FIG. 1 is referred to as a front side of the spark plug 10, and the upper side in the sheet of FIG. 1 is referred to as a rear side of the spark plug 10.

As shown in FIG. 1, the spark plug 10 includes an insulator 11, a center electrode 13 (first electrode), a metallic shell 17, and a ground electrode 18 (second electrode). The insulator 11 is a substantially cylindrical member formed of alumina or the like that is excellent in mechanical property and insulation property at high temperature. The insulator 11 has an axial hole 12 which penetrates therethrough along the axis O.

The center electrode 13 is a rod-shaped electrode that is inserted in the axial hole 12 so as to be held by the insulator 11 along the axis O. The center electrode 13 includes an electrode base material 14, and a tip 15 joined to a front end of the electrode base material 14. In the electrode base material 14, a core material excellent in thermal conductivity is embedded. The electrode base material 14 is formed of an alloy containing Ni as a main ingredient, or a metal material made of Ni. The core material is formed of copper or an alloy containing copper as a main ingredient. As a matter of course, the entirety of the electrode base material 14 may be formed of an alloy containing Ni as a main ingredient, or a metal material made of Ni, with the core material being omitted.

The tip 15 is formed of: a noble metal such as platinum, iridium, ruthenium, or rhodium having higher spark wear resistance than the electrode base material 14; or an alloy containing such a noble metal as a main ingredient. In the present embodiment, the tip 15 is joined to the electrode base material 14 by laser welding.

The metal terminal 16 is a rod-shaped member to which a high-voltage cable (not shown) is connected, and the front side of the metal terminal 16 is arranged in the insulator 11. The metal terminal 16 is electrically connected to the center electrode 13 in the axial hole 12. The metallic shell 17 is a substantially cylindrical metallic member that is fixed in a screw hole (not shown) of an internal combustion engine. The metallic shell 17 is fixed to the outer circumference of the insulator 11.

The ground electrode 18 includes: an electrode base material 19 joined to the metallic shell 17; and a tip 20 joined to the electrode base material 19. In the electrode base material 19, a core material excellent in thermal conductivity is embedded. The electrode base material 19 is formed of an alloy containing Ni as a main ingredient, or a metal material made of Ni. The core material is formed of copper or an alloy containing copper as a main ingredient. As a matter of course, the entirety of the electrode base material 19 may be formed of an alloy containing Ni as a main ingredient, or a metal material made of Ni, with the core material being omitted.

The tip 20 is formed of: a noble metal such as platinum, iridium, ruthenium, or rhodium having higher spark wear resistance than the electrode base material 19; or an alloy containing such a noble metal as a main ingredient. The electrode base material 19 is bent toward the center electrode 13, and the tip 20 is opposed to the center electrode 13 with a spark gap interposed therebetween. In the present embodiment, the tip 20 is joined to the electrode base material 19 by resistance welding.

The spark plug 10 is manufactured by, for example, the following method. First, the center electrode 13 is inserted in the axial hole 12 of the insulator 11. The tip 15 is welded to the electrode base material 14 of the center electrode 13 in advance. The center electrode 13 is arranged such that a front end thereof is exposed from the axial hole 12 to the outside. After the metal terminal 16 is inserted in the axial hole 12 such that electrical conduction between the metal terminal 16 and the center electrode 13 is ensured, the metallic shell 17 with the electrode base material 19 joined thereto in advance is mounted on the outer circumference of the insulator 11. After the tip 20 is joined to the electrode base material 19, the electrode base material 19 is bent such that the tip 20 is opposed to the center electrode 13 in a direction of the axis O, thereby obtaining the spark plug 10.

Figure 2:
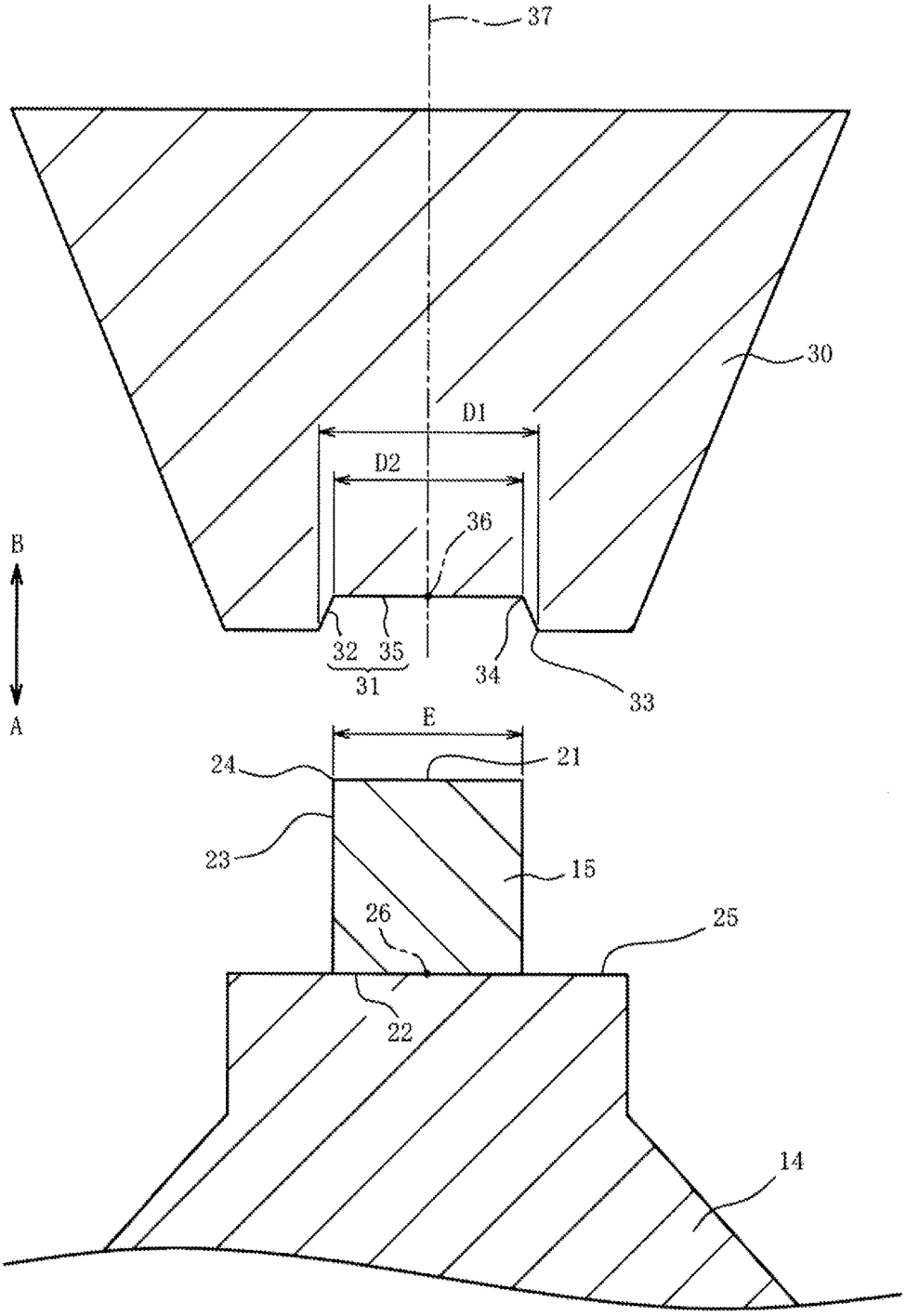
FIG. 2 is a sectional view of a jig and a tip, according to a first embodiment.
Figure 3:
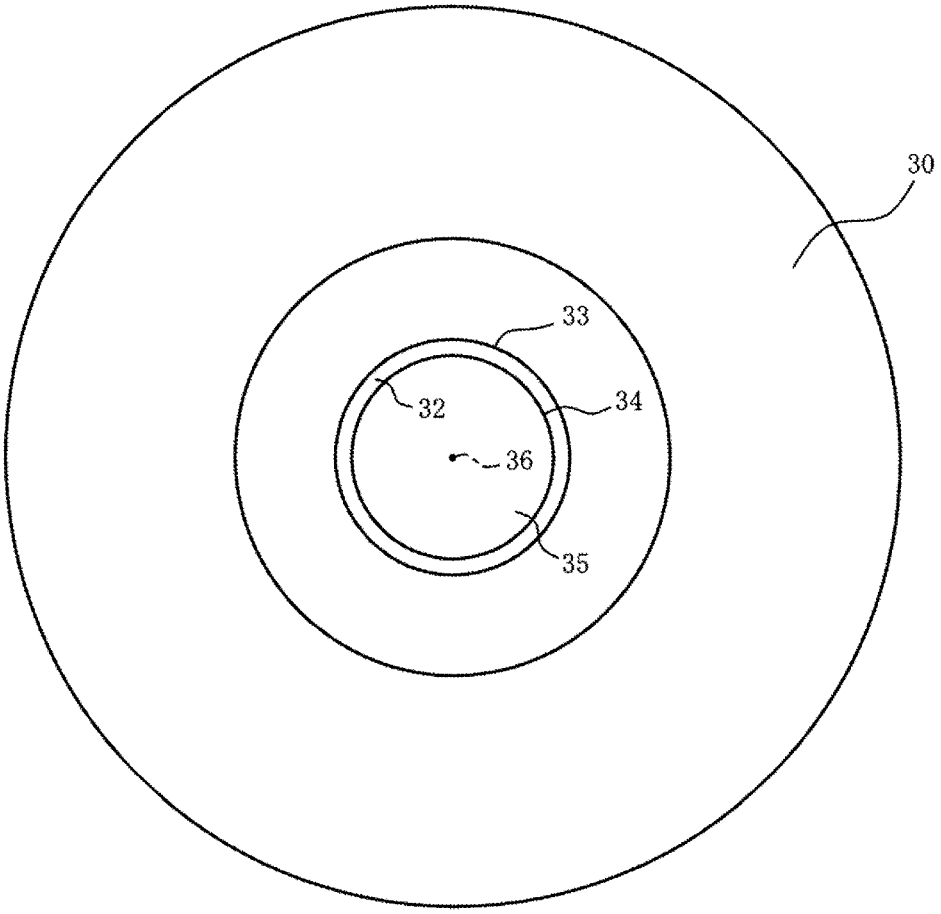
FIG. 3 is a bottom view of the jig.

A method for welding the electrode base material 14 and the tip 15 of the center electrode 13 to each other will be described with reference to FIG. 2 to FIGS. 4A and 4B. FIG. 2 is a sectional view of a jig 30 and the tip 15, according to a first embodiment, and FIG. 3 shows a bottom view of the jig 30. In FIG. 2, an arrow A represents a direction (first direction) of force of pressing the tip 15 against the electrode base material 14 via the jig 30, and an arrow B represents a direction (second direction) opposite to the first direction.

As shown in FIG. 2, the tip 15 has: a first surface 21; a second surface 22 on a side opposite to the first surface 21; and a side surface 23 contiguous to the first surface 21 and the second surface 22. In the present embodiment, the tip 15 is formed in a cylindrical shape. The first surface 21 is a surface that is opposed to the tip 20 (see FIG. 1) of the ground electrode 18, with a spark gap interposed therebetween. The second surface 22 is a surface that comes into contact with a base material surface 25 of the electrode base material 14. The tip 15 has a circular edge 24 at which the side surface 23 and the first surface 21 meet each other.

The base material surface 25 of the electrode base material 14 is a surface to which the tip 15 is welded, and a target position 26 for welding is set on the base material surface 25. When the tip 15 is to be welded, the center of the second surface 22 of the tip 15 is aligned with the target position 26, whereby the accuracy for the position of the tip 15 relative to the electrode base material 14 can be enhanced. While the position of the tip 20 of the ground electrode 18 relative to the target position 26 on the center electrode 13 is set and the spark gap is controlled, misalignment between the target position 26 and the tip 15 is controlled, whereby ignitability of the spark plug 10 can be ensured. The target position 26 is set at, for example, the center of the base material surface 25.

As shown in FIG. 2 and FIG. 3, the jig 30 is a member for pressing the tip 15 in the first direction (arrow A direction) against the electrode base material 14 so that: the position, relative to the target position 26, of the tip 15 not having been welded is corrected; the tip 15 is inhibited from being misaligned at the time of welding; and heat dissipation from the tip 15 at the time of welding is facilitated. The jig 30 has a recessed portion 31 which comes into contact with the edge 24 of the tip 15 so as to apply load on the tip 15. In the present embodiment, the jig 30 is formed of a material having hardness higher than the hardness of the tip 15.

The recessed portion 31 has: a diameter-decreasing portion 32 having an inner dimension that decreases toward the second direction (arrow B direction); and a bottom portion 35 contiguous to the diameter-decreasing portion 32. The inner dimension of the diameter-decreasing portion 32 means the diameter of an imaginary circle which is inscribed in the diameter-decreasing portion 32 and which is perpendicular to the first direction (arrow A direction) (a circle, of which the circumference is a portion of the diameter-decreasing portion 32). The diameter-decreasing portion 32 has a first end portion 33 in the first direction, and a second end portion 34 in the second direction. Since the bottom portion 35 is contiguous to the second end portion 34, a center 36 of the diameter-decreasing portion 32 at the second end portion 34 (a center of a circle, of which the circumference is the second end portion 34 and which is perpendicular to the first direction) and a center 36 of the bottom portion 35 coincide with each other.

In the diameter-decreasing portion 32, an inner dimension D2 of the second end portion 34 is smaller than an inner dimension D1 of the first end portion 33. The inner dimension D1 is larger than an outer dimension E of the edge 24 of the tip 15, and the inner dimension D2 is equal to the outer dimension E. The outer dimension E of the edge 24 of the tip 15 means the diameter of an imaginary circumscribed circle which is circumscribed about the first surface 21 (edge 24) of the tip 15 and which is perpendicular to the first direction. In the present embodiment, the diameter-decreasing portion 32 is a curved surface that is recessed to have a truncated cone shape, and the bottom portion 35 is a circular flat surface. The diameter-decreasing portion 32 is a surface that is rotationally symmetric so as to coincide with itself after rotating by any angle about a center axis 37 passing the center 36 and extending toward the first direction.

The electrode base material 14 and the jig 30 are attached to a holding device (not shown). The holding device causes the electrode base material 14 and the jig 30 to rotate relative to each other about the center axis 37 and to move relative to each other in the first direction and the second direction that are orthogonal to the base material surface 25.

Figure 4B:
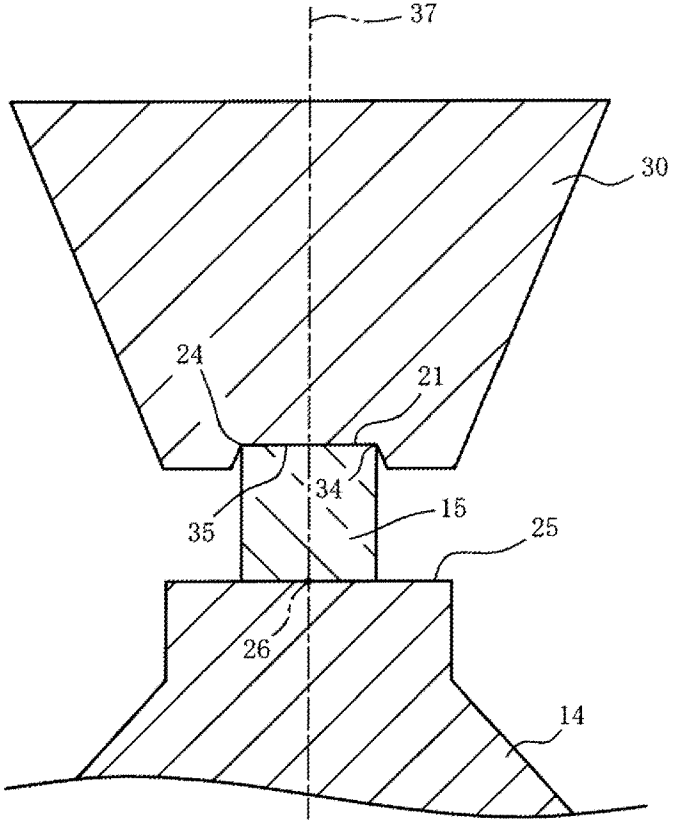
FIG. 4B is a sectional view of the jig and the tip in the second half of the pressing step.
Figure 4A:
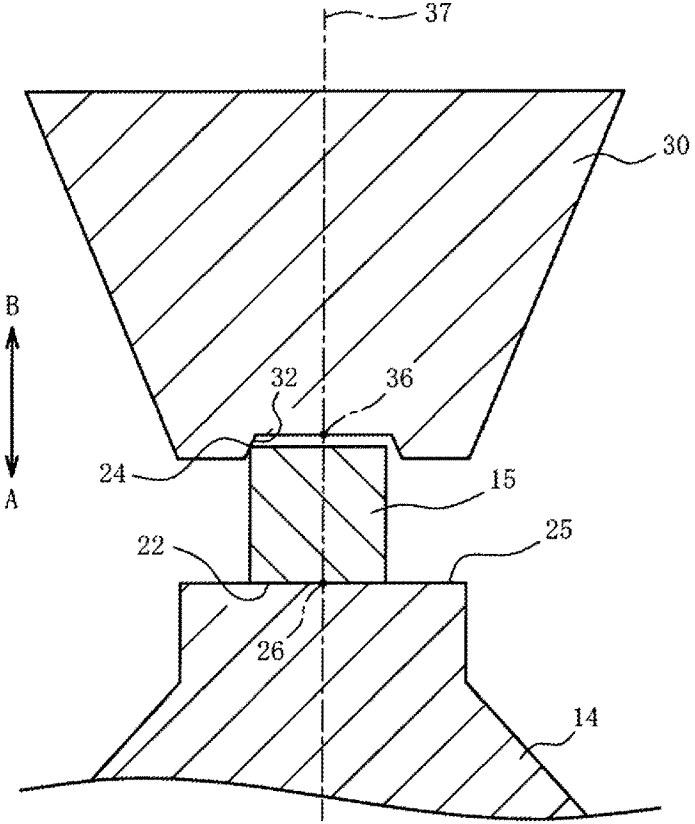
FIG. 4A is a sectional view of the jig and the tip in the first half of a pressing step.

Next, a pressing step of correcting the position of the tip 15 relative to the electrode base material 14, and a welding step of welding, to the electrode base material 14, the tip 15 of which the position has been corrected, will be described with reference to FIGS. 4A and 4B. FIG. 4A is a sectional view of the jig 30 and the tip 15 in the first half of the pressing step, and FIG. 4B is a sectional view of the jig 30 and the tip 15 in the second half of the pressing step.

As shown in FIG. 4A, in the pressing step, the position of the jig 30 relative to the electrode base material 14 is set at first such that the center axis 37 passing the center 36 of the diameter-decreasing portion 32 and extending in the first direction (arrow A direction) passes the target position 26 on the electrode base material 14. In addition, an angle of the jig 30 relative to the electrode base material 14 is set such that the bottom portion 35 of the jig 30 comes to be parallel to the base material surface 25 of the electrode base material 14. The distance in the first direction between the jig 30 and the base material surface 25 of the electrode base material 14 is detected by a sensor (not shown).

Next, the tip 15 is placed near the target position 26 on the base material surface 25 of the electrode base material 14, with the second surface 22 being brought into contact with the base material surface 25. Then, the diameter-decreasing portion 32 of the jig 30 is brought into contact with the edge 24 of the tip 15 by the holding device (not shown), and, while load is being applied relatively in the first direction (arrow A direction) to the tip 15 via the jig 30, the jig 30 and the electrode base material 14 are rotated relative to each other about the center axis 37 by desired angles. The tip 15 of which the edge 24 is pressed along a slope of the diameter-decreasing portion 32 moves on the base material surface 25 so as to approach the target position 26.

When the tip 15 moves to the target position 26 and the edge 24 of the tip 15 reaches the second end portion 34 of the diameter-decreasing portion 32, the bottom portion 35 of the jig 30 comes into contact with the entirety of the first surface 21 of the tip 15. The distance in the first direction between the electrode base material 14 and the jig 30 becomes the shortest at this time. Therefore, by comparing an output result from the sensor with a distance (known set value), between the electrode base material 14 and the jig 30, that is obtained when the bottom portion 35 of the jig 30 comes into contact with the entirety of the first surface 21 of the tip 15, it is determined whether or not the tip 15 is located within an allowable range of the target position 26.

As a result of the determination, in a case where the tip 15 has not reached the allowable range of the target position 26, the jig 30 is moved in the second direction (arrow B direction) so as to remove the load being applied to the tip 15 by the jig 30, and thereafter, the jig 30 is moved in the first direction (arrow A direction) again. While force is being applied in the first direction to the tip 15, the jig 30 and the electrode base material 14 are rotated relative to each other about the center axis 37 by desired angles. Such application of load in the first direction and removal of the load are repeated until the tip 15 is determined to reach the allowable range of the target position 26.

As shown in FIG. 4B, after the tip 15 reaches the allowable range of the target position 26, the bottom portion 35 of the jig 30 is pressed against the first surface 21 of the tip 15. Then, a machining head (not shown) of a laser welding machine is rotated relative to the electrode base material 14 and the tip 15 so as to be centered on the target position 26, and a laser beam (not shown) is continuously or intermittently applied to a boundary between the tip 15 and the electrode base material 14. Accordingly, the tip 15 can be welded at the target position 26 on the electrode base material 14.

A rotation rate R1 of the jig 30 relative to the electrode base material 14 at the time of correction of the position of the tip 15 before welding, is preferably set to be not higher than a rotation rate R2 of the machining head of the laser welding machine relative to the electrode base material 14 and the tip 15. This is because, although the position of the tip 15 can be corrected even when the rotation rate R1 is low, variation in the size of a welded portion formed by applying a laser beam can be made smaller as the rotation rate R2 is higher.

In addition, when the machining head of the laser welding machine is rotated relative to the electrode base material 14 and the tip 15, the jig 30 may be rotated together with the electrode base material 14, or the jig 30 may not be rotated together with the electrode base material 14. It should be noted that, by rotating the jig 30 together with the electrode base material 14, a scratch can be prevented from being formed on the tip 15 by the jig 30 scraping the edge 24 or the first surface 21 of the tip 15.

Instead of joining the tip 15 to the electrode base material 14 by laser welding, the tip 15 may be joined to the electrode base material 14 by resistance welding. Since the bottom portion 35 of the jig 30 comes into contact with the entirety of the first surface 21 of the tip 15, contact resistance between the tip 15 and the jig 30 can be reduced. Therefore, by applying current between the jig 30 and the electrode base material 14, the jig 30 and the electrode base material 14 can be melted and adhered to each other by Joule heat generated owing to contact resistance between the electrode base material 14 and the tip 15.

As described above, in the diameter-decreasing portion 32 of the jig 30, the inner dimension gradually decreases toward the second direction (arrow B direction) opposite to the first direction (arrow A direction), and thus, when load in the first direction is applied to the edge 24 of the tip 15 via the diameter-decreasing portion 32, the tip 15 moves along the base material surface 25 to the target position 26. Therefore, the position of the tip 15 can be corrected before welding.

The diameter-decreasing portion 32 is rotationally symmetric about the center axis 37 passing the center 36 and extending toward the first direction (arrow A direction), and thus, by pressing the tip 15 in the first direction with use of the jig 30, the tip 15 can be easily moved toward the center 36 of the diameter-decreasing portion (the center of an inscribed circle which is inscribed in the second end portion 34 and which is perpendicular to the first direction). In addition, in the pressing step, by bringing the diameter-decreasing portion 32 into contact with the edge 24 of the tip 15 while the jig 30 and the electrode base material 14 are rotated relative to each other, the tip 15 can be further easily moved toward the center 36 of the diameter-decreasing portion 32.

In the pressing step, since the bottom portion 35 comes into contact with the entirety of the first surface 21 of the tip 15 after the diameter-decreasing portion 32 comes into contact with the edge 24 of the tip 15, the area of contact between the jig 30 and the tip 15 can be increased as compared with a case where the edge 24 of the tip 15 is pressed by the jig 30. Since it is possible to disperse load that is applied by the jig 30 to the tip 15 at the time of welding, the edge 24 of the tip 15 can be prevented from being damaged.

In the pressing step, since the tip 15 is pressed in the first direction (arrow A direction) by bringing the diameter-decreasing portion 32 into contact with the edge 24 of the tip 15 in a state where the target position 26 and the center 36 of the diameter-decreasing portion 32 are aligned with each other, the position of the tip 15 can be corrected to the target position 26 just by pressing the jig 30 in the first direction even without moving the jig 30 in a direction orthogonal to the first direction. It can be made unnecessary to provide, for example, a mechanism for moving the jig 30 in a direction orthogonal to the first direction, or a sensor for detecting the amount of the movement, whereby the mechanism for moving the jig 30 can be simplified.

Next, a second embodiment will be described with reference to FIGS. 5A and 5B, and FIG. 6. In the first embodiment, a case has been described where the jig 30 corrects the position of the tip 15 by applying force in the first direction to the tip 15. On the other hand, in the second embodiment, a case will be described where a jig 50 corrects the position of a tip 40 by applying force to the tip 40 in the first direction (arrow A direction) and a third direction (arrow C direction) orthogonal to the first direction. The same components as described in the first embodiment will be denoted by the same reference numerals, and the description thereof is omitted.

Figure 5B:
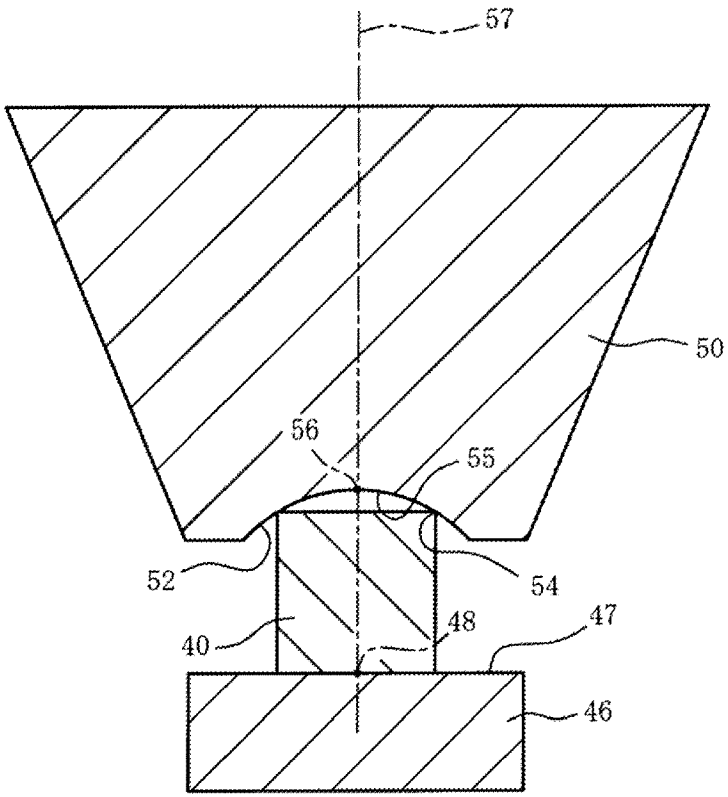
FIG. 5B is a sectional view of the jig and the tip in the second half of the pressing step.
Figure 5A:
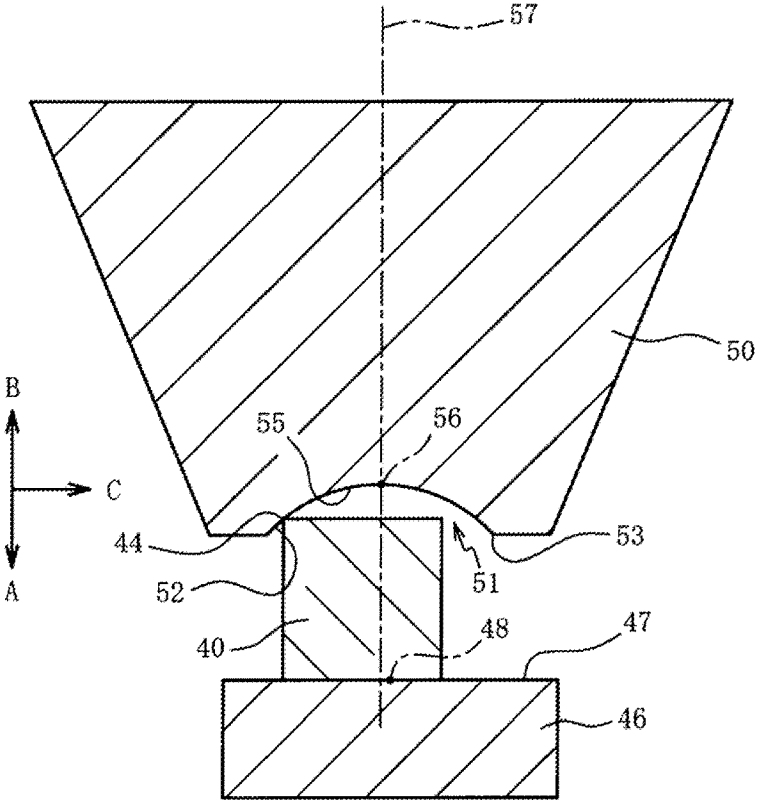
FIG. 5A is a sectional view of a jig and a tip in the first half of the pressing step performed with use of the jig, according to a second embodiment.

FIG. 5A is a sectional view of the jig 50 and the tip 40 in the first half of the pressing step performed with use of the jig 50, according to the second embodiment, and FIG. 5B is a sectional view of the jig 50 and the tip 40 in the second half of the pressing step. FIG. 6 is a perspective view schematically illustrating the jig 50 and the tip 40. Regarding the jig 50, FIG. 6 schematically shows only a recessed portion 51 for easy understanding.

Figure 6:
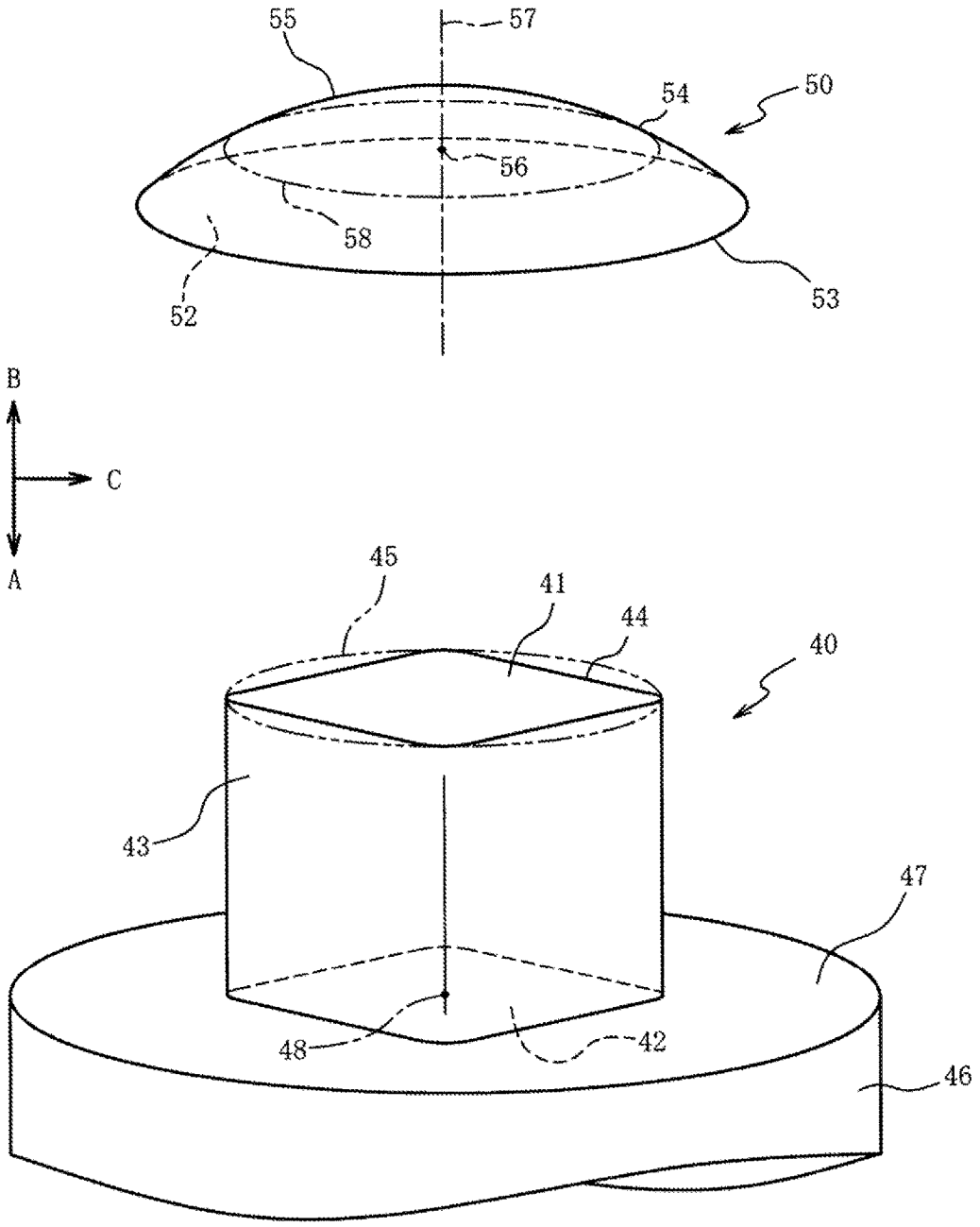
FIG. 6 is a perspective view schematically illustrating the jig and the tip.

As shown in FIG. 6, the tip 40 is a prismatic-shape member having: a rectangular first surface 41; a rectangular second surface 42 on a side opposite to the first surface 41; and a side surface 43 contiguous to the first surface 41 and the second surface 42. The tip 40 has an edge 44 at which the side surface 43 and the first surface 41 meet each other. An outer dimension E of the edge 44 of the tip 40 means the diameter of an imaginary circumscribed circle 45 which is circumscribed about the first surface 41 (edge 44) of the tip 40 and which is perpendicular to the first direction.

The tip 40 is welded to an intermediate material 46. The intermediate material 46 is a portion of the ground electrode 18 (see FIG. 1; first electrode), and formed of an alloy containing Ni as a main ingredient or a metal material made of Ni, so as to have a substantially cylindrical shape. The tip 40 is welded at a target position 48 in a state where the second surface 42 is in contact with a base material surface 47 of the intermediate material 46. The intermediate material 46 to which the tip 40 is welded is joined to the electrode base material 19 by resistance welding or the like. By bending the electrode base material 19 with the tip 40 joined thereto via the intermediate material 46, the tip 40 is opposed to the center electrode 13 (second electrode).

As shown in FIG. 5A, in the jig 50, the recessed portion 51 which comes into contact with the edge 44 of the tip 40 thereby to apply load to the tip 40, is formed. In the present embodiment, the recessed portion 51 is a recess formed as the inner surface of a spherical crown obtained by cutting a sphere along one plane. The recessed portion 51 has: a diameter-decreasing portion 52 having an inner dimension that decreases toward the second direction (arrow B direction); and a bottom portion 55 contiguous to the diameter-decreasing portion 52.

The inner dimension (inner diameter) D1 (see FIG. 6) of a first end portion 53 in the first direction of the diameter-decreasing portion 52 is larger than an outer dimension E of the tip 40. The inner dimension (inner diameter) D2 of a second end portion 54 in the second direction of the diameter-decreasing portion 52 is equal to the outer dimension E of the tip 40. The diameter-decreasing portion 52 is a surface that is rotationally symmetric so as to coincide with itself after rotating by any angle about a center axis 57 passing a center 56 of the diameter-decreasing portion 52 at the second end portion 54 (the center 56 of a circle 58 which is inscribed in the second end portion 54 and which is perpendicular to the first direction) and extending toward the first direction. The intermediate material 46 and the jig 50 are attached to a holding device (not shown). The holding device causes the intermediate material 46 and the jig 50 to rotate relative to each other about the center axis 57 and to move relative to each other in the first direction (second direction) of the center axis 57 and the third direction (arrow C direction) orthogonal to the center axis 57.

As shown in FIG. 5A, in the pressing step, before the tip 40 is welded to the intermediate material 46, the position of the jig 50 relative to the intermediate material 46 is set such that the target position 48 on the intermediate material 46 is present at a portion in the third direction (arrow C direction) relative to the center axis 57 of the jig 50. The distance in the first direction between the jig 50 and the base material surface 47 of the intermediate material 46, and the distance in the third direction between the target position 48 and the center 56 of the jig 50, are detected by sensors (not shown).

Next, the tip 40 is placed near the target position 48 on the intermediate material 46, with the second surface 42 being brought into contact with the base material surface 47, such that the target position 48 on the intermediate material 46 is present at a portion in the third direction (arrow C direction) relative to the center of the tip 40. Then, force is applied to the tip 40 in the first direction (arrow A direction) and the third direction (arrow C direction) by pressing the diameter-decreasing portion 52 of the jig 50 against the edge 44 of the tip 40, until the center 56 of the jig 50 reaches the target position 48 in the third direction (arrow C direction). The tip 40 of which the edge 44 is pressed along the slope of the diameter-decreasing portion 52 moves on the base material surface 47 so as to approach the target position 48.

Such application of load to the tip 40 by the jig 50 is kept performed until it is determined that an output from the sensor (not shown) for detecting the distance in the first direction between the jig 50 and the base material surface 47 of the intermediate material 46 and an output from the sensor (not shown) for detecting the distance in the third direction between the target position 48 and the center 56 of the jig 50, fall within allowable ranges. In a state where the edge 44 of the tip 40 reaches the second end portion 54 of the diameter-decreasing portion 52, the distance in the first direction between the jig 50 and the base material surface 47 of the intermediate material 46 is the shortest. Until it is determined that this distance reaches the allowable range and that the tip 40 reaches the allowable range of the target position 48, such application of load in the first direction and the third direction and removal of the load are repeated.

As shown in FIG. 5B, after the tip 40 reaches the allowable range of the target position 48, the machining head (not shown) of the laser welding machine is rotated relative to the intermediate material 46 and the tip 40, and a laser beam (not shown) is continuously or intermittently applied to the boundary between the tip 40 and the intermediate material 46, in a state where the diameter-decreasing portion 52 is pressed against the edge 44 of the tip 40. Accordingly, the tip 40 can be welded at the target position 48 on the intermediate material 46. Therefore, similarly to the first embodiment, the position of the tip 40 relative to the intermediate material 46 can be corrected before welding, with use of the jig 50 for pressing the tip 40 at the time of welding.

Figure 7A:
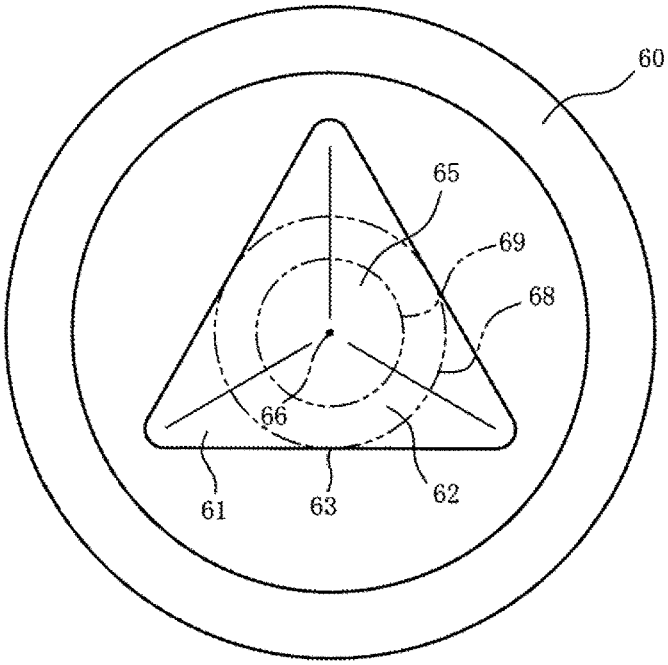
FIG. 7A is a bottom view of a jig according to a third embodiment.

Next, a third embodiment will be described with reference to FIGS. 7A and 7B. In the first embodiment and the second embodiment, cases have been described where the diameter-decreasing portion 32, 52 is formed as an annular curved surface. On the other hand, in the third embodiment, a case will be described where a recessed portion 61 is formed as a polyhedron obtained by connecting a plurality of flat surfaces. The same components as described in the first embodiment will be denoted by the same reference numerals, and the description thereof is omitted. FIG. 7A shows a bottom view of a jig 60 according to the third embodiment, and FIG. 7B is a sectional view of the jig 60 and the tip 15.

Figure 7B:
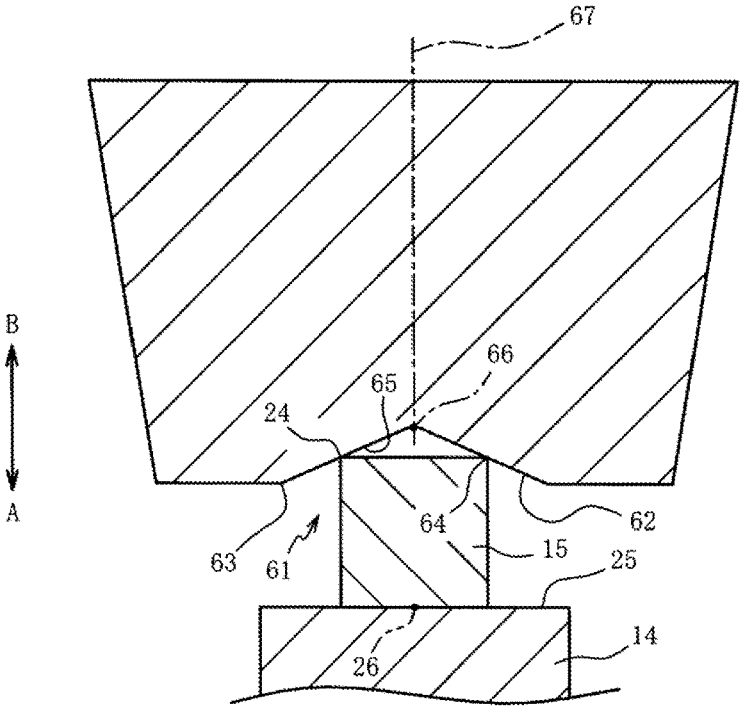
FIG. 7B is a sectional view of the jig and the tip.

As shown in FIG. 7A and FIG. 7B, the recessed portion 61 which comes into contact with the edge 24 of the tip 15 so as to apply load to the tip 15, is formed in the jig 60. The recessed portion 61 is a recess formed as the inner surface of a triangular pyramid obtained by connecting equal sides of isosceles triangles to each other. The recessed portion 61 has: a diameter-decreasing portion 62 having an inner dimension that decreases toward the second direction (the farther side in the sheet of FIG. 7A); and a bottom portion 65 contiguous to a second end portion 64 of the diameter-decreasing portion 62.

The inner dimension D1 of a first end portion 63 in the first direction (the nearer side in the sheet of FIG. 7A) of the diameter-decreasing portion 62 is the diameter of an imaginary inscribed circle 68 which is inscribed in the surfaces of the diameter-decreasing portion 62 at the first end portion 63 and which is perpendicular to the first direction (arrow A direction). The second end portion 64 of the diameter-decreasing portion 62 is such a portion that the diameter (inner dimension D2) of an imaginary inscribed circle 69 which is inscribed in the surfaces of the diameter-decreasing portion 62 at the second end portion 64 and which is perpendicular to the first direction (arrow A direction), is equal to the outer dimension E of the tip 15. The inner dimension D1 is larger than the outer dimension E of the tip 15. The diameter-decreasing portion 62 is a surface that is rotationally symmetric so as to coincide with itself after rotating by 120° about a center axis 67 passing a center 66 of the diameter-decreasing portion 62 at the second end portion 64 (the center of the inscribed circle 69) and extending toward the first direction.

Similarly to the first embodiment, since the diameter-decreasing portion 62 is rotationally symmetric about the center axis 67, the jig 60 according to the third embodiment enables the position of the tip 15 to be corrected by pressing the diameter-decreasing portion 62 in the first direction (arrow A direction) against the edge 24 of the tip 15 while the jig 60 and the electrode base material 14 are rotated relative to each other about the center axis 67. Thereafter, the tip 15 is welded to the electrode base material 14. In addition, since the recessed portion 61 is formed as a polyhedron that comes to be narrower toward the second direction (arrow B direction), load can be applied to various tips 15 having different outer dimensions E by bringing the recessed portion 61 into contact therewith.

Figure 8:
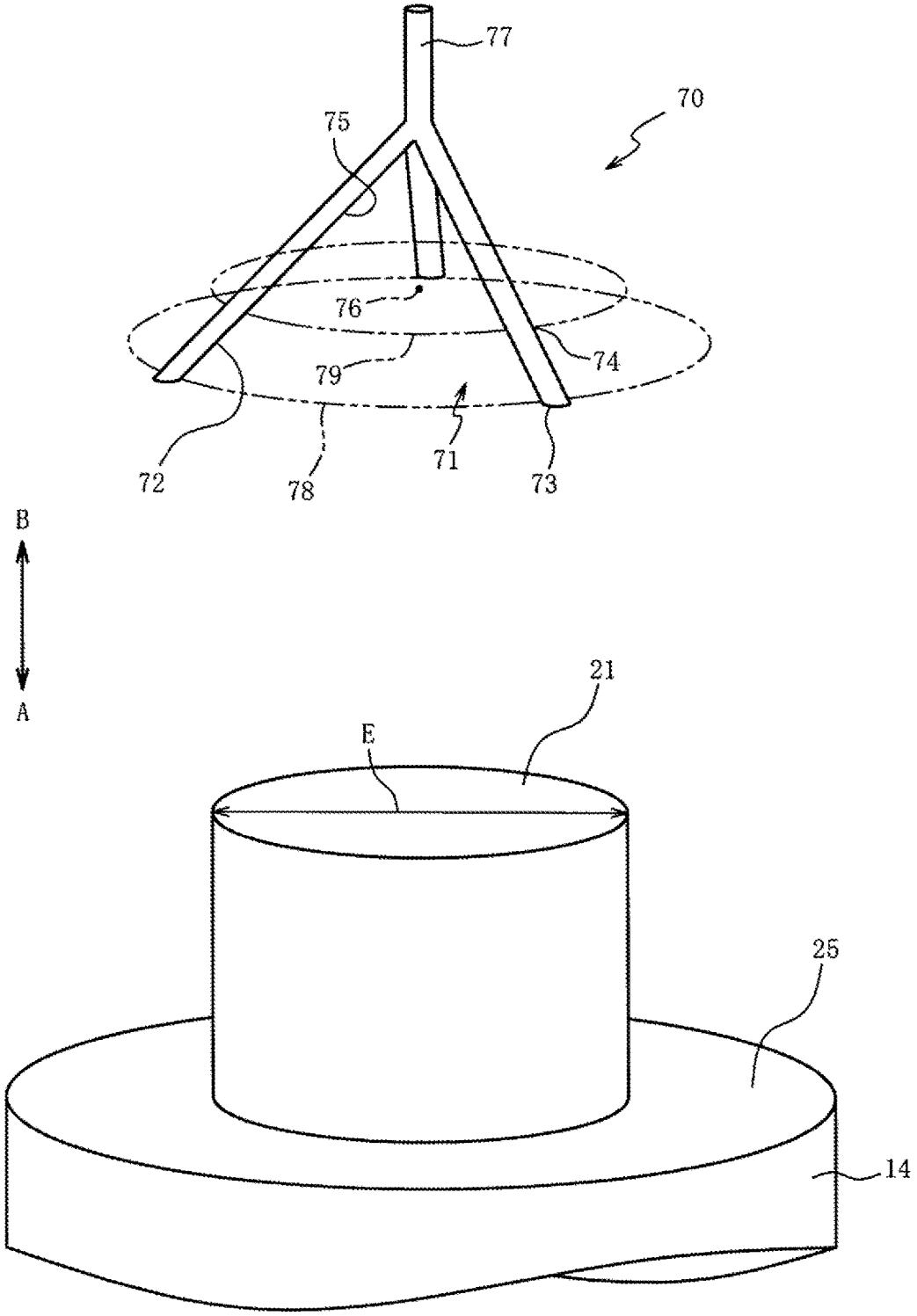
FIG. 8 is a perspective view schematically illustrating a jig and the tip, according to a fourth embodiment.

Next, a fourth embodiment will be described with reference to FIG. 8. In the first embodiment to the third embodiment, cases have been described where the jig 30, 50, 60 includes the diameter-decreasing portion 32, 52, 62 formed by the flat surfaces or the curved surface continuous in the circumferential direction. On the other hand, in the fourth embodiment, a case will be described where a jig 70 includes diameter-decreasing portions 72 separated from each other in the circumferential direction. The same components as described in the first embodiment will be denoted by the same reference numerals, and the description thereof is omitted. FIG. 8 is a perspective view schematically illustrating the jig 70 and the tip 15, according to the fourth embodiment.

As shown in FIG. 8, the jig 70 is formed of three rod-shaped members that stretch out from a center shaft 77 toward the first direction (arrow A direction). A recessed portion 71 of the jig 70 has: the diameter-decreasing portions 72 having an inner dimension that decreases toward the second direction (arrow B direction); and bottom portions 75 contiguous to second end portions 74 of the diameter-decreasing portions 72.

The second end portions 74 of the diameter-decreasing portions 72 are such portions that the diameter (inner dimension D2) of an imaginary inscribed circle 79 which is inscribed in parts of the diameter-decreasing portions 72 at the second end portions 74 and which is perpendicular to the first direction (arrow A direction), is equal to the outer dimension E of the tip 15. The inner dimension D1 of first end portions 73 in the first direction (arrow A direction) of the diameter-decreasing portions 72 is the diameter of an imaginary inscribed circle 78 which is inscribed in parts of the diameter-decreasing portions 72 at the first end portions 73 and which is perpendicular to the first direction (arrow A direction). The inner dimension D1 is larger than the outer dimension E of the tip 15. The diameter-decreasing portions 72 are rotationally symmetric so as to coincide with itself after rotating by 120° about an extension line, of the center shaft 77, which passes a center 76 of the diameter-decreasing portions 72 at the second end portions 74 (the center of the inscribed circle 79) and which extends toward the first direction.

Similarly to the first embodiment, since the diameter-decreasing portions 72 are rotationally symmetric about the center shaft 77, the jig 70 according to the fourth embodiment enables the position of the tip 15 to be corrected by pressing the diameter-decreasing portions 72 in the first direction (arrow A direction) against the edge 24 of the tip 15 while the jig 70 and the electrode base material 14 are rotated relative to each other about the center shaft 77.

Figure 9A:
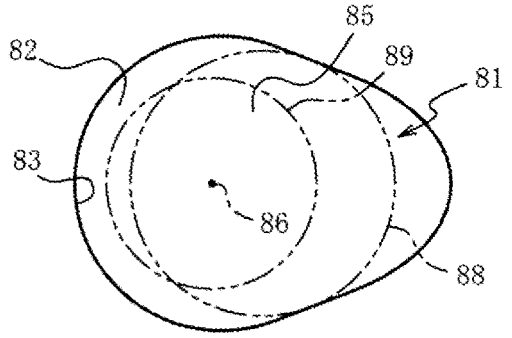
FIG. 9A is a bottom view of a jig according to a fifth embodiment.
Figure 9B:
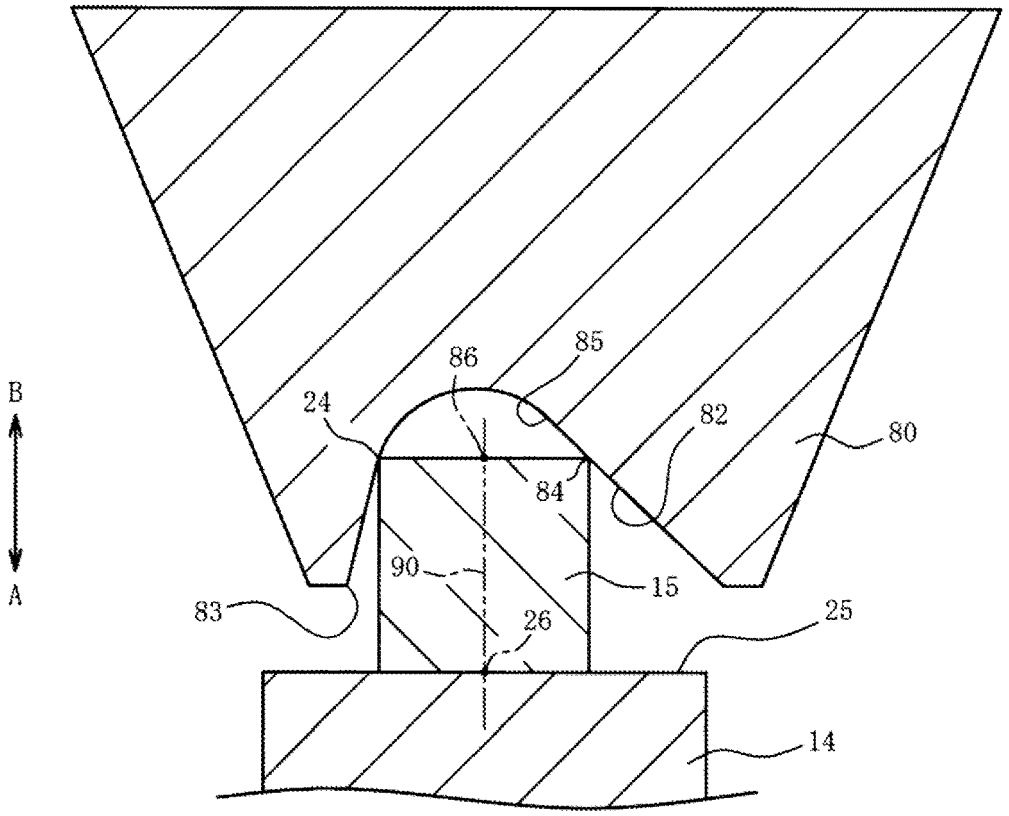
FIG. 9B is a sectional view of the jig and the tip.

Next, a fifth embodiment will be described with reference to FIGS. 9A and 9B. In the first embodiment to the fourth embodiment, cases have been described where the diameter-decreasing portion 32, 52, 62, 72 of the jig 30, 50, 60, 70 is rotationally symmetric about the center axis 37, 57, 67 or the center shaft 77. On the other hand, in the fifth embodiment, a jig 80 having no center axis about which a diameter-decreasing portion 82 thereof is rotationally symmetric will be described. The same components as described in the first embodiment will be denoted by the same reference numerals, and the description thereof is omitted. FIG. 9A shows a bottom view of the jig 80 according to the fifth embodiment, and FIG. 9B is a sectional view of the jig 80 and the tip 15. FIG. 9A shows only a recessed portion 81 of the jig 80 for easy understanding.

As shown in FIG. 9A and FIG. 9B, the recessed portion 81 of the jig 80 has: the diameter-decreasing portion 82 having an inner dimension that decreases toward the second direction (arrow B direction); and a bottom portion 85 contiguous to the diameter-decreasing portion 82. A first end portion 83 in the first direction (the nearer side in the sheet of FIG. 9A) of the diameter-decreasing portion 82 is formed in a substantially elliptic shape. The inner dimension D1 of the first end portion 83 is the diameter of an imaginary circle 88 which is inscribed in the diameter-decreasing portion 82 at the first end portion 83 and which is perpendicular to the first direction (parallel to the sheet of FIG. 9A). A second end portion 84 of the diameter-decreasing portion 82 is such a portion that the diameter (inner dimension D2) of an imaginary inscribed circle 89 which is inscribed in the diameter-decreasing portion 82 at the second end portion 84 and which is perpendicular to the first direction (arrow A direction), is equal to the outer dimension E of the tip 15. The inner dimension D1 is larger than the outer dimension E of the tip 15.

When the tip 15 is to be welded to the electrode base material 14, the position of the jig 80 relative to the electrode base material 14 is set at first such that a straight line 90 passing a center 86 of the diameter-decreasing portion 82 (the center of the inscribed circle 89) and extending in the first direction (arrow A direction) passes the target position 26 on the electrode base material 14. Next, after the tip 15 is placed near the target position 26 on the base material surface 25 of the electrode base material 15, the jig 80 and the base material surface 25 are brought close to each other in the first direction (arrow A direction) so that the diameter-decreasing portion 82 is brought into contact with the edge 24 of the tip 15. Load is applied in the first direction (arrow A direction) to the tip 15 via the jig 80 so as to move the tip 15 with use of the slope of the diameter-decreasing portion 82 so that the tip 15 is brought close to the target position 26. Such application of load in the first direction and removal of the load are repeated until it is determined that the tip 15 reaches the allowable range of the target position 26. After the position of the tip 15 is corrected, the tip 15 is welded to the electrode base material 14.

Since also the jig 80 according to the fifth embodiment has the diameter-decreasing portion 82, the position of the tip 15 can be corrected by pressing the diameter-decreasing portion 82 against the edge 24 of the tip 15 and applying load in the first direction (arrow A direction).

As described above, although the present invention has been described based on the embodiments, the present invention is not limited to the above-described embodiments at all. It can be easily understood that various modifications can be devised without departing from the gist of the present invention. For example, the shapes and the dimensions of the electrode base material 14, the intermediate material 46, and the tip 15, 40 are mere examples and may be appropriately set.

In the second embodiment, a case has been described where the tip 40 is joined to the electrode base material 19 via the intermediate material 46, but the present invention is not necessarily limited thereto. As a matter of course, the ground electrode 18 (first electrode) may be formed by joining the tip 40 to the electrode base material 19, with the intermediate material 46 being omitted.

In the third embodiment, a case has been described where the recessed portion 61 is formed by connecting three flat surfaces, but the present invention is not necessarily limited thereto. As a matter of course, the recessed portion may be formed by connecting four or more flat surfaces.

In the fourth embodiment, a case has been described where the recessed portion 71 is formed by connecting three straight rod-shaped members, but the present invention is not necessarily limited thereto. As a matter of course, the recessed portion may be formed by connecting four or more rod-shaped members. In addition, as a matter of course, the recessed portion may be formed by connecting three or more bent rod-shaped members. As a matter of course, instead of the rod-shaped members or in addition to the rod-shaped members, sheet-like members may be used which each have a relatively large width along the circumferential direction of an object to be machined. As the sheet-like member, both a sheet-like member having a flat surface and a sheet-like member having a curved surface may be used.

In the first to fourth embodiments, cases have been described where load is applied to the tip 15, 40 while the jig 30, 50, 60, 70 and the tip 15, 40 are rotated relative to each other about the center axis 37, 57, 67 or the center shaft 77, but the present invention is not necessarily limited thereto. Even without rotating the jig 30, 50, 60, 70 and the tip 15, 40 relative to each other, the position of the tip 15, 40 can be corrected with use of the diameter-decreasing portion 32, 52, 62, 72 by applying force in the first direction (arrow A direction) to the tip 15, 40 with use of the jig 30, 50, 60, 70.

In the above-described embodiments, cases have been described where, at the time of welding, the machining head (not shown) of the laser welding machine and the object to be machined are rotated relative to each other and a laser beam is applied to the object to be machined, but the present invention is not necessarily limited thereto. As a matter of course, the welding may be performed by applying, toward the object to be machined, laser beams from a plurality of points in the circumferential direction around the object to be machined.

In each of the above-described embodiments, the embodiment may be modified by, for example, a part or plural parts of the structure of another embodiment being added to the embodiment, or a part or plural parts of the structure being exchanged between the embodiment and another embodiment. For example, as a matter of course, the jigs 30, 60, 70, 80 described in the first, third, fourth, and fifth embodiments may be used when providing the tip 20, 40 to the ground electrode 18. Similarly, as a matter of course, the jig 50 described in the second embodiment may be used when providing the tip 15 to the center electrode 13.

As a matter of course, the intermediate material 46 described in the second embodiment may be used when the center electrode 13 is to be formed. The center electrode 13 (first electrode) can be formed by joining the tip 15, 40 to the electrode base material 14 via the intermediate material 46.

DESCRIPTION OF REFERENCE NUMERALS

10: spark plug
13: center electrode (first electrode, second electrode)
14: electrode base material
15, 40: tip
18: ground electrode (first electrode, second electrode)
21, 41: first surface
22, 42: second surface
23, 43: side surface
24, 44: edge
26, 48: target position
30, 50, 60, 70, 80: jig
31, 51, 61, 71, 81: recessed portion
32, 52, 62, 72, 82: diameter-decreasing portion
33, 53, 63, 73, 83: first end portion
34, 54, 64, 74, 84: second end portion
35: bottom portion
36, 56, 66, 76, 86: center
37, 57, 67: center axis
77: center shaft
46: intermediate material (portion of first electrode)

What is claimed is:

1. A method for manufacturing a spark plug, the spark plug including a first electrode and a second electrode, the first electrode including a noble-metal-containing tip joined to an electrode base material, the second electrode opposed to a first surface of the tip with a spark gap interposed therebetween, the tip having a second surface on a side opposite the first surface, the method comprising:

a pressing step of pressing the tip with a jig in a first direction from the first surface of the tip toward the second surface of the tip when the second surface of the tip is in contact with the electrode base material; and a welding step of welding the electrode base material to the tip being pressed by the jig, wherein the tip further has a side surface contiguous to the first surface and the second surface, and an edge at which the side surface and the first surface meet each other, the jig has a recessed portion to be brought into contact with the edge, the recessed portion has a diameter-decreasing portion having an inner dimension that gradually decreases in a second direction opposite to the first direction, a first end portion of the diameter-decreasing portion in the first direction having an inner dimension larger than an outer dimension of the edge, and a second end portion of the diameter-decreasing portion in the second direction having an inner dimension equal to the outer dimension of the edge, and, in the pressing step, the diameter-decreasing portion is brought into contact with at least a portion of the edge, and the tip is moved to a target position on the electrode base material to which the tip is to be welded.

2. The method for manufacturing the spark plug according to claim 1, wherein the diameter-decreasing portion of the jig is rotationally symmetric about a center axis passing through a center of the diameter-decreasing portion and extending in the first direction.

3. The method for manufacturing the spark plug according to claim 2, wherein, in the pressing step, the diameter-decreasing portion of the jig is brought into contact with the edge of the tip while the jig and the electrode base material are rotated relative to each other.

4. The method for manufacturing the spark plug according to claim 1, wherein the recessed portion of the jig has a bottom portion contiguous to the second end portion of the diameter-decreasing portion, and, in the pressing step, after the diameter-decreasing portion of the jig comes into contact with the edge of the tip, the bottom portion comes into contact with an entirety of the first surface of the tip.

5. The method for manufacturing the spark plug according to claim 1, wherein, in the pressing step, when the target position on the electrode base material and a center of the diameter-decreasing portion at the second end portion are aligned with each other, the diameter-decreasing portion is brought into contact with the edge, and the tip is pressed in the first direction.

* * * * *